United States Patent [19]

Anderson

[11] Patent Number: 4,768,534

[45] Date of Patent: Sep. 6, 1988

[54] PORTABLE CLEANING APPARATUS

[76] Inventor: Max F. Anderson, R.R. #1, Stewardson, Ill. 62463

[21] Appl. No.: 607,743

[22] Filed: May 7, 1984

[51] Int. Cl.[4] ..... B08B 3/02

[52] U.S. Cl. ..... 134/175; 134/183; 134/200

[58] Field of Search ..... 134/166 R, 167 R, 168 R, 134/169 R, 172, 174, 175, 176, 178, 179, 198, 200, 182, 183

[56] References Cited

U.S. PATENT DOCUMENTS

| | | | |
|---|---|---|---|
| 2,896,643 | 7/1959 | Ottoson | 134/99 |
| 3,416,544 | 12/1968 | Palva | 134/102 |
| 4,052,227 | 10/1977 | Delo et al. | 134/200 X |
| 4,117,855 | 10/1978 | Olcott et al. | 134/176 X |
| 4,433,698 | 2/1984 | Blavl | 134/200 X |
| 4,444,213 | 4/1984 | Taylor | 134/200 X |

*Primary Examiner*—Harvey C. Hornsby
*Assistant Examiner*—Frankie L. Stinson
*Attorney, Agent, or Firm*—Victor R. Beckman

[57] ABSTRACT

A portable cleaning apparatus for cleaning dishes, vegetables, fish, or like items, is disclosed comprising a base, or tray, and removable hood or cover supported thereon to form a cleaning chamber. An inlet opening is formed at the top of the hood through which a rigid hand-held feed conduit extends. A resilient seal at the inlet opening provides a liquid tight engagement between the feed conduit and hood while permitting manual axial and pivotal movement in any pivotal direction of the feed conduit. A nozzle is provided at the inner end of the feed conduit from which liquid is jetted for cleaning items contained in the cleaning chamber. A high pressure pump in communication with a source of liquid pumps the liquid to the nozzle through a flexible supply conduit connected to the feed conduit. At least a portion of the hood is formed of transparent material for viewing the nozzle and items to be cleaned by the jet stream issuing from the nozzle. An outlet is formed at the bottom of the hood through which liquid may drain from the cleaning chamber. An arm access opening is provided in the hood through which the user's arm may be extended for moving and positioning the items to be cleaned. A cover is provided for covering the arm access opening when not in use.

11 Claims, 1 Drawing Sheet

PORTABLE CLEANING APPARATUS

TECHNICAL FIELD

The present invention is directed to a portable cleaning apparatus for use in cleaning dishes, vegetables, fish, and like goods or items by means of a high pressure liquid stream which is directed upon the goods or items by a hand-held nozzle.

BACKGROUND OF THE INVENTION

Dishwashers are known as shown in many patents including U.S. Pat. No. 2,561,631—Negri. Also, tank washers for washing the insides of empty tanks or containers are shown in U.S. Pat. Nos. 3,916,924—McGowan; 2,896,643—Ottoson; and 3,448,742—Bender.

SUMMARY OF THE INVENTION AND OBJECTS

An object of this invention is the provision of an improved portable cleaning apparatus which is readily adapted for a variety of cleaning uses including the cleaning of dishes, vegetables, fish and like goods or items.

An object of this invention is the provision of a portable cleaning apparatus of the abovementioned type which employs a high pressure, low volume, liquid jet stream for blasting the goods to clean the same.

The above and other objects and advantages of this invention are achieved by use of a transparent portable cover, or hood, that is adapted to rest upon a base and which, together with the base, defines a cleaning chamber. An inlet opening is provided in the hood through which a rigid hand-positionable feed conduit extends, and the inner end of the feed conduit is provided with a nozzle for jetting a liquid stream onto the items to be cleaned. A high pressure pump pumps liquid from a source thereof to the nozzle through the feed conduit. A resilient seal member is included at the inlet opening to provide for liquid tight sealing engagement between the opening and the feed conduit while permitting manual axial and pivotal movement of the feed conduit in any pivotal direction. An access opening is formed in the hood through which the user's arm may be extended for positioning and holding goods to be cleaned, and a cover is included for closing the access opening when desired. A rack may be located inside the chamber for support of the goods thereon in a generally upright position to facilitate access thereto by the jet stream.

BRIEF DESCRIPTION OF THE DRAWINGS

The invention will be better understood from the following detailed description thereof in connection with the accompanying drawings. In the drawings, wherein like reference characters refer to the same parts in the several views:

Reference first is made to FIG. 1 of the drawings wherein there is shown a portable cleaning apparatus 10 comprising a base 12 and hood, or cover, 14 positioned thereon. The hood 14, together with the base 12 (or other surface upon which the hood may be positioned) define a cleaning chamber 16 in which the items or goods to be cleaned are located. In FIG. 1, a rack 18 for supporting dishes in a generally upright position to facilitate cleaning thereof is shown inside the chamber, together with a plate 20 to be cleaned. The hood 14, or at least a portion thereof, is formed of a transparent material, such as rigid clear plastic, to allow for viewing the goods or items to be cleaned therethrough.

Figure 2:
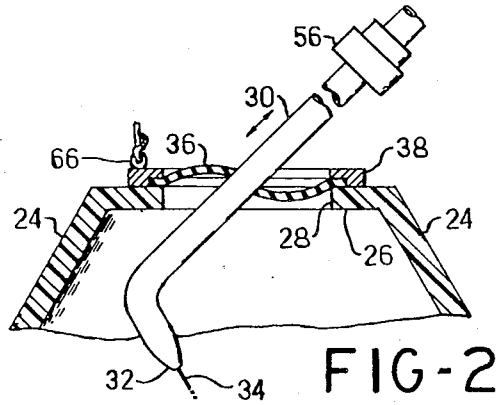
FIG. 2 is an enlarged fragmentary sectional view taken along line 2—2 of FIG. 1 and showing the mounting for the rigid hand-positionable feed conduit included therein.

The illustrated cover 14 is shown to comprise generally vertical side walls 22 at the bottom thereof, inwardly inclined walls 24 extending from the upper edges of the vertical walls, and a flat top 26. Obviously, other shaped hoods, or covers, may be employed in the practice of this invention. An inlet opening 28 (see FIG. 2) is formed in the top of the hood through which a rigid hand-positionable feed conduit 30 extends. The conduit is curved, adjacent the inner end thereof, and a nozzle 32 is formed at the inner end thereof through which liquid is jetted at high pressure to produce a jet stream 34. A shut off valve is included in the conduit 30, which valve is controlled by a thumb actuated operating lever 31 thereat.

The opening 28 is closed by a resilient membrane 36 attached to the hood by any suitable means such as an annular ring 38 which is secured to the hood by any suitable means, such as cement or adhesive, not shown. The rigid conduit 30 extends through an aperture in the center of the membrane 36. The flexible membrane 36 provides for a liquid tight seal between the rigid conduit 30 and hood 14 while allowing for easy manual movement of the rigid conduit axially and in any pivotal direction to facilitate directing of the jet stream 34 onto the items or goods to be cleaned.

Liquid for cleaning may be obtained from any suitable supply such as a household faucet or tap 40 at a sink 42 which, in turn, is located in a counter or drain board 44 upon which the cleaning apparatus 10 is positioned. A supply hose 46 extends from the faucet to a high pressure pump 48 operated by an electric motor 50 when the motor is turned on by switch 52. The pump outlet is connected through a high pressure outlet hose 54 and coupling 56 to the rigid conduit 30. The normal household water pressure, generally ranging up to 60 psi, normally is insufficient for cleaning purposes. A high pressure jet stream blast is required, which is provided by high pressure pump 48 which functions to increase the pressure to at least approximately 100 psi. A pump which is capable of operating at a pressure of between 100 and 500 psi is preferred for adequate cleaning of many articles. The nozzle 32 has a small diameter opening therein to limit the volume flow of liquid in the jet stream 34. Due to the high pressure employed, the small stream is jetted at a high velocity to dislodge dirt and debris from the articles to be cleaned.

Figure 1:
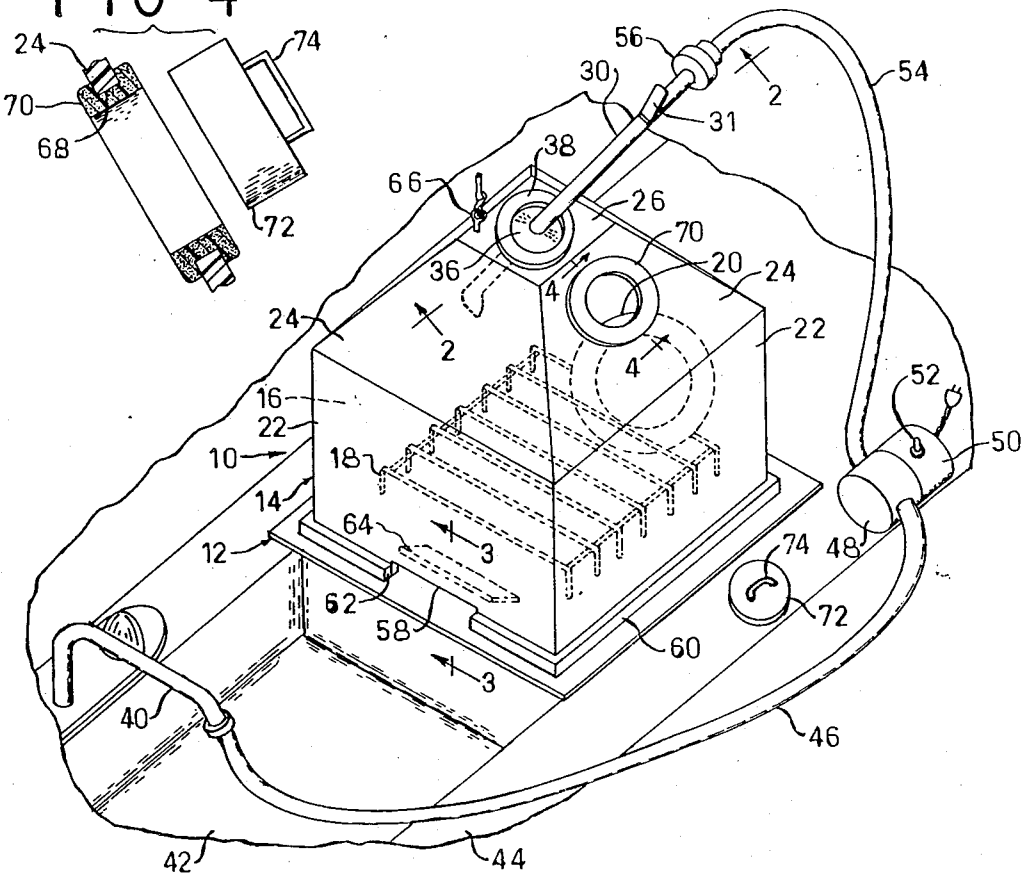
FIG. 1 is a perspective view of a portable cleaning apparatus which embodies the present invention.

A cut-out, or notch, 58 is formed at the lower edge of the hood through which liquid may drain from under the hood. In FIG. 1, the edge of the base 12 is shown extending over the edge of the sink 42 for draining of liquid directly into the sink from the base 12. A low vertical wall, or band, 60 is shown formed on the base, inside of which the walls 22 of the hood 14 are positioned, which wall 60 serves to locate the hood on the base, and to minimize passage of water out from under the hood except through the notch 58 in the hood. An associated opening 62 is formed in the wall 60 to allow for passage of water through the notch 58 and thence through the opening 62 for draining into the sink 42. A deflector 64 is located inside the hood 14 above the drain notch 58 to prevent the jet stream 34 from being directed directly at the notch 58. Also, an eyelet, or like fastening device, 66 may be provided on the hood for use in suspending the same from the ceiling or wall of the room when not in use.

Figure 4:
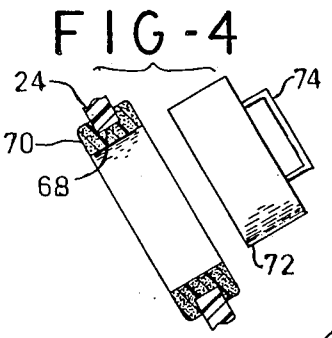
FIG. 4 is an enlarged fragmentary sectional view taken along line 4—4 of FIG. 1 and showing the arm access opening and associated cover therefor.
Figure 3:
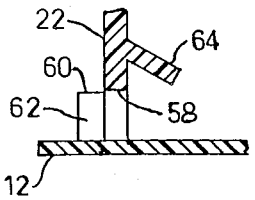
FIG. 3 is an enlarged fragmentary sectional view taken along line 3—3 of FIG. 1 and showing the drain opening at one side of the hood.

The hood 14 is provided with one or more arm access openings and, for purposes of illustration, one such access opening 68 is shown (see FIG. 4). A resilient bushing, or grommet, 70 is located at the opening to provide a seal between the opening and the users arm extended therethrough. With this arrangement, the user may extend one arm through the opening to manipulate the items or goods to be cleaned so as to expose all desired surfaces thereof to the jet stream 34 for complete cleaning of the items or goods. A removable cover 72, having a handle 74, is used to close the arm access opening when the opening is not used during cleaning. In the illustrated arrangement, the cover 72 is maintained in position in the resilient bushing 70 by frictional engagement therewith. Obviously, covers of other types, may be used for closing the arm access opening if desired.

In operation dishes or other items or goods to be cleaned are loaded onto the base 12, and the hood 14 is positioned thereon. A rack 18 or other suitable holder for the items to be cleaned may be employed inside the cleaning chamber. Supply hose 46 is connected to a supply of cleaning liquid, such as faucet 40, and the water faucet is turned on. The rigid hand-held conduit 30 is extended through the aperture in the flexible membrane 36 by the operator. When motor switch 52 is turned on and valve operating lever 31 is depressed, a high pressure jet stream 34 issues from the nozzle 32, which jet stream is directed onto the items to be cleaned by hand manipulation of the rigid conduit 30. For many items to be cleaned, the nozzle at the rigid conduit 30 may be manipulated such that the jet stream 34 directly impinges upon all of the surfaces to be cleaned. However, when all of the surfaces to be cleaned are not directly accessible to the jet stream with the item in a fixed position, the cover 72 is removed from the arm access opening 68 in the hood, and the operator's other arm is extended therethrough into the cleaning chamber. The item to be cleaned is moved by the operator's hand inside the cleaning chamber into a position for cleaning of all desired surfaces by the jet stream 34. Since both hands may be employed in both directing the jet stream 34 and positioning the item within the cleaning chamber during the cleaning operation, all surfaces may be cleaned without having to stop the cleaning operation, removing the hood form the base, repositioning the item to be cleaned, and restarting the cleaning operation.

The invention having been described in detail in accordance with requirements of the Patent Statutes, various changes and modifications will suggest themselves to those skilled in this art. For example, the apparatus may be used without the base member 12, if desired, in which case the hood 14 may be placed directly on some other supporting surface, such as the bottom of the sink 42, to form a washing chamber therewith. Also, other racks or supporting devices may be employed for cleaning other items or goods. For example, to clean fish, the rack 18 may be replaced by a board with a spring-operated clamp or clip attached thereto for clamping the fish to the board. The high pressure jet stream 34 readily removes scales from the fish. Additionally, by inserting the jet stream into the fish's mouth, the entrails are readily removed therefrom. Also, liquid from sources other than a faucet may be used for cleaning. For example, liquid may be pumped from containers thereof. Additionally, a cleaning agent, such as soap or detergent, may be added to the contents of the container if desired to promote cleaning by the jet stream blast. Obviously, liquids other than water may be used, if desired. It is intended that the above and other such changes and modifications shall fall within the spirit and scope of the invention as defined in the appended claims.

I claim:

1. In a cleaning apparatus for blasting dishes, vegetables, fish or like items to be cleaned with a high pressure liquid jet stream comprising, a hood having a top portion and a wall portion extending downwardly from the top portion and forming an open bottom, said hood being adapted for removable support on a substantially horizontal base and together with the base defining a cleaning chamber, a rigid hand-positionable feed conduit having a nozzle at one end, an inlet opening formed in the hood through which said feed conduit extends, sealing means at the inlet opening providing sealing engagement between the feed conduit and hood while permitting manual axial and pivotal movement of the feed conduit in any pivotal direction of the feed conduit from outside the cleaning chamber, means for supplying cleaning liquid under pressure to said feed conduit and jetting the liquid from the nozzle onto items to be cleaned, and means for draining liquid from the cleaning chamber.

2. In a cleaning apparatus as defined in claim 1 wherein said means for supplying cleaning liquid to said feed conduit comprises a high pressure pump adapted for connection to a liquid supply source, and a flexible hose connecting the outlet from the pump to the feed conduit.

3. In a cleaning apparatus as defined in claim 1 wherein said sealing means comprises a resilient membrane closing said inlet opening, said membrane being formed with a central hole through which said rigid hand-positionable feed conduit extends in liquid tight engagement therewith.

4. In a cleaning apparatus as defined in claim 1 including an arm access opening formed in said hood through which the user's arm is extendable for grasping items to be cleaned inside the cleaning chamber.

5. In a cleaning apparatus as defined in claim 4 including a resilient annular member at said arm access opening to provide a sealing engagement with the user's arm extended therethrough.

6. In a cleaning apparatus as defined in claim 4 including a removable cover for said arm access opening for closing the opening for use of the apparatus without the user's arm extended therethrough.

7. In a cleaning apparatus as defined in claim 1 wherein at least a portion of said hood is transparent for viewing items in said cleaning chamber through said hood.

8. In a cleaning apparatus as defined in claim 1 wherein said means for draining liquid from the cleaning chamber comprises a notch formed in the hood at a bottom edge thereof.

9. In a cleaning apparatus as defined in claim 1 including means for supporting items to be cleaned in the cleaning chamber.

10. In a cleaning apparatus as defined in claim 9 wherein said supporting means comprises a rack.

11. In a cleaning apparatus as defined in claim 1 wherein the top portion of said hood includes a truncated pyramid-shaped portion and an upper horizontal member formed with said inlet opening through which said feed conduit extends.

* * * * *